US007244147B2

(12) United States Patent
De La Cruz

(10) Patent No.: US 7,244,147 B2
(45) Date of Patent: Jul. 17, 2007

(54) TRANSFORMER FOR QUADRAXIAL COAXIAL STRUCTURES

(75) Inventor: José De La Cruz, Parigne l'eveque (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 11/392,389

(22) Filed: Mar. 29, 2006

(65) Prior Publication Data

US 2006/0246775 A1 Nov. 2, 2006

(30) Foreign Application Priority Data

Mar. 29, 2005 (FR) ..... 05 50802

(51) Int. Cl.
*H01R 13/40* (2006.01)

(52) U.S. Cl. ..... 439/599; 439/610; 439/934; 439/941

(58) Field of Classification Search ..... 439/752, 439/610, 599, 598, 695, 941, 934
See application file for complete search history.

(56) References Cited

U.S. PATENT DOCUMENTS

| | | | | |
|---|---|---|---|---|
| 4,464,540 | A | 8/1984 | Reeder | |
| 6,290,532 | B1 | 9/2001 | Vermeersch et al. | |
| 6,616,482 | B2 * | 9/2003 | De La Cruz et al. | 439/610 |
| 6,669,502 | B1 * | 12/2003 | Bernhart et al. | 439/460 |
| 6,773,303 | B1 * | 8/2004 | Lin | 439/578 |
| 7,044,789 | B2 * | 5/2006 | Yohn et al. | 439/599 |
| 2003/0199205 | A1 | 10/2003 | Kosmala | |

FOREIGN PATENT DOCUMENTS

| | | |
|---|---|---|
| EP | 0308092 | 3/1989 |
| WO | WO 97/12428 | 4/1997 |
| WO | WO98/28822 | 7/1998 |

OTHER PUBLICATIONS

Tyco Electronics Catalog 1308940, Section 3-Rack and Panel Connectors, ARINC 600, ARINC Size 8 QUADRAX Solder Contacts, p. 3024 (Revised May 2003).
Search Report for Application No. GB0604968.8 dated Jun. 30, 2006.

* cited by examiner

*Primary Examiner*—Tho D. Ta
(74) *Attorney, Agent, or Firm*—Patterson, Thuente, Skaar & Christensen, P.A.

(57) ABSTRACT

A connector equipped with an insulant comprising four channels. Each channel is able to receive at the location of a rear extremity a strand of a cable, and at the location of a front extremity an end of a contact in order to connect each strand to an end. The connector comprises a ferrule equipped with four cavities arranged in such a way that a front extremity of each cavity coincides with a rear extremity of a channel of the insulant in such a way that each strand connected to an end in the connector extends in a cavity of the ferrule and in a corresponding channel of the insulant. The invention also relates to a process for fitting the coaxial cables in such a connector.

10 Claims, 1 Drawing Sheet

TRANSFORMER FOR QUADRAXIAL COAXIAL STRUCTURES

RELATED APPLICATION

The present application claims priority to French Application No. 05 50802 filed Mar. 29, 2005.

TECHNICAL FIELD

The invention relates to a multi-point controlled impedance connector that is able to allow connection between coaxial cables and interior contacts. More precisely, the invention relates to a multi-point connector in which the cables and contacts are fitted in such a way as to obtain practically no crosstalk. More particularly, the invention relates to a ferrule, fitted in a multi-point connector, that is able to guide four coaxial cables inside the connector.

BACKGROUND ART

Multi-strand cables are characterized by their characteristic impedance and crosstalk control. This characteristic impedance and crosstalk are principally determined according to the geometry of the cable, as well as according to the materials utilized to form this cable. Geometry is meant to refer to, more particularly, the disposition of cable strands inside an insulant of this cable, as well as the respective distances between each of the cable strands, and the respective distances between each cable strand and a cable braid. In fact, the cables generally comprise a braid surrounding the insulant on an exterior periphery, the insulant retaining the strands. Furthermore, the strands of the cable are twisted inside the insulant. It is known that fitting a cable in a connector has the consequence of modifying the characteristic impedance of the link at the level of this connector. This is especially due to the fact that the geometry is modified inside the connector.

As the characteristic impedance of the link is not constant, a loss in adaptation of the link is observed. Especially when high-frequency currents are transported by this link, on observes losses in the signal due to variations in the characteristic impedance and crosstalk. This is explained by the fact, among others, that the geometry of the connector is different from that of the link.

A multi-point connector ensuring continuity in the characteristic impedance and crosstalk control of a multi-strand cable is known from document FR 2 814 598. The multi-point connector of the prior art is equipped with an insulant comprising four channels in which the strands of the quadraxial cable extend when they are untwisted. The channels are arranged parallel to the longitudinal axis of said insulant in order to conserve a symmetrical quadraxial structure. Risks of crosstalk, linked to the fact that the cable strands are untwisted inside the connector, are eliminated.

FIG. 1 represents the connector for a quadraxial cable from the prior art. The multi-point connector 1 of the prior art is equipped with a cylindrical tubular body 2 in which is fitted an insulant 3 and four contacts 4 (two visible in FIG. 1). A quadraxial cable 5 is introduced at a rear extremity 6 of the body 2 so that the strands 7 of the cable 5 are introduced in the insulant 3. Each strand 7 may be connected to an end 8 of a contact 4. For this, the insulant comprises four channels. The untwisted strands 7 of the cable 5 and the ends 8 of the contacts 4 extend inside the channels, the connection between the strands 7 and the ends 8 of the contacts 4 takes place in said channels. The geometry of the disposition of channels between them, for example, the spacing of the channels between them, is calculated in such a way that the characteristic impedance of cable 5 at the level of this insulant 3 is almost identical to the characteristic impedance of cable 5.

The body 2 of the multi-point connector 1 is conductive in order to ensure a continuity of the shield with a braid 9 of the cable 5. At the location of the rear extremity of the multi-point connector 1, the cable 5 is partially stripped, that is, the cable lacks the insulating sheath 10, the braid 9 is maintained between the wall of the body 2 and a ferrule 11. The twisted strands 7 of the cable 5 extend inside the ferrule 11. The strands 7 are untwisted only at the location of the insulant 3 in order to be connected to the corresponding ends 8.

The multi-point connector of the prior art therefore allows a quadraxial structure with practically no crosstalk to be maintained inside the connector, as is the case along the entire quadraxial cable. Quadraxial structure refers to a structure in which four cable strands are disposed symmetrically with relation to each other in such a way that no crosstalk exists.

However, the quadraxial symmetry of the cable is necessarily broken at the extremities of said cable, in order to connect the cable strands to the components on an electronic board for example. To do this, it is in fact necessary to separate the two strands forming the conductors/emitters from the two strands forming the conductors/receivers to connect the strands to the corresponding components on the electronic board. Crosstalk control in a quadraxial assembly is only effective if the strands of the emitter and receiver are on the diagonals of the quadraxial square. The quadraxial structure of the cable is therefore broken at the location of the electronic board, which leads to crosstalk that may be significant, with a consequent loss of performance of the link at the location of the connection.

SUMMARY OF THE INVENTION

The multi-point connector according to the invention is particularly useful when the quadraxial structure of the cable strands as such inside the multi-point connector must be modified at the end of said multi-point connector in order to connect said strands to an electronic device. The invention may, for example, be utilized with links that are able to transport high frequencies. The invention therefore finds applications in the field of on-board networks, for example in the field of avionics.

An object of the invention is to eliminate crosstalk problems that may appear during changing the quadraxial cable structure at the level of the electronic component to which it must be connected.

To arrive at this result, the invention proposes showing four coaxial cables inside a quadraxial connector. Quadraxial connector refers to a contact or connector in which the quadraxial structure of four cable strands is maintained. At the end of the contact or connector, the strands respectively connected to the contacts inside the connector have a coaxial structure in order to eliminate any risk of crosstalk. The quadraxial symmetrical disposition of the four coaxial cables inside the connector is obtained through a ferrule disposed at the location of a rear extremity of the connector. The ferrule allows the coaxial cables to be brought up to the channels of an insulant fitted at the second extremity of the connector. The connection between each of the cores of the coaxial cables and a corresponding contact is done inside the channels. The ferrule of the invention is a conductive material in order to allow the connection of each exterior conductor of the coaxial cable to the ground of the transmission device. Therefore, this structure transformation allows the quadraxial structure of the cables at the end of the connector to be broken since the crosstalk levels due to the change in structure are controlled by using the shield properties of these coaxial cables. Due to the presence of a shield braid in each coaxial cable, the risks of crosstalk are controlled no matter the disposition of the coaxial cables with relation to each other, particularly their crossovers.

The coaxial cable comprises a metallic sheath, or shield, surrounding the core of the cable. The metallic sheath allows transmitted data to be protected and data distortion to be avoided. In a particular example of embodiment of the invention, the connector is constructed in such a way that the metallic sheaths of the coaxial cables penetrate in the ferrule. The metallic sheath of the coaxial cables, in contact with the conductive ferrule of the connector according to the invention, allows each of the coaxial cables to be connected to the ground. Under the metallic sheath, the coaxial cable comprises an insulant maintaining the core of the cable. The cable core is stripped in order to be introduced in an end of a contact, inside the connector insulant, in which the connection takes place.

The coaxial cables used have a characteristic impedance compatible with the impedances of the networks utilized, for example 50 Ohms for the Ethernet and 75 Ohms for fiber channels.

Therefore, the object of the invention is a connector equipped with an insulant comprising four channels, each channel being able to receive a cable at the location of a rear extremity, and an end of a contact at the location of a front extremity in order to connect each cable to an end, characterized in that the connector is equipped with a ferrule, the ferrule being equipped with four cavities arranged in such a way that a front extremity of each cavity coincides with a rear extremity of a channel of the insulant in such a way that each strand connected to an end in the connector can be extended in a cavity of the ferrule and in a corresponding channel of the insulant.

In particular examples of embodiment of the connector of the invention, said connector comprises part or all of the following additional characteristics:

- the cavities in the ferrule have symmetrical quadraxial geometries;
- the insulant and the ferrule have a general tubular shape;
- the ferrule is in a conductive material;
- a diameter of the cavities is fully greater than a diameter of the channels;
- an external wall of the ferrule is in contact with an internal wall of a body of the connector.

The invention also relates to a ferrule that is able to be introduced in a body of a connector, said ferrule being equipped with four internal cavities extending parallel to a longitudinal axis of the ferrule. The ferrule according to the invention may be in a conductive material.

The invention also relates to a method for fitting coaxial cables on a connector according to the invention, comprising the steps consisting of:

- stripping a first extremity of a coaxial cable in such a way as to obtain a first section of cable surrounded by a braided metallic sheath, a second section surrounded by an insulating sheath and a third section consisting of the core of the cable, the third section forming the free extremity of the cable;
- introducing the cable in a cavity of the ferrule until the first section is housed in the cavity;
- introducing the cable in a corresponding channel of the insulant until the second and third sections are housed in the channel;
- proceeding the same way for the three other coaxial cables;
- fitting the ferrule and insulant, equipped with coaxial cables, in a body of the connector.

According to the examples of implementation of the process according to the invention, it is possible to add part or all of the following additional steps consisting of:

- crimping the body of the contact on the ferrule;
- soldering the ferrule on the body of the contact;
- introducing a contact at an opposite extremity of the channel in such a way that the core of the cable is housed in the end of the contact.

BRIEF DESCRIPTION OF THE DRAWINGS

The invention will be better understood upon reading the following description and examining the accompanying figures. The figures are presented for indication purposes only and in no way limit the invention. The figures represent.

DETAILED DESCRIPTION OF THE DRAWINGS

Figure 1:
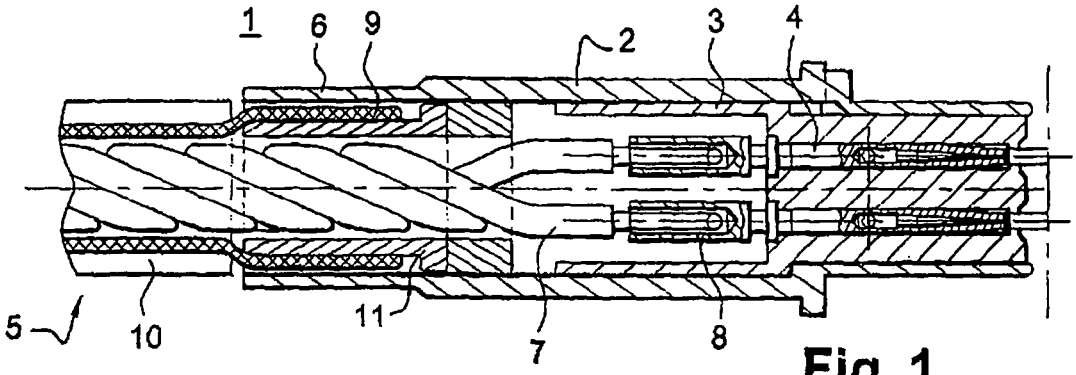
Fig. 1 Prior art
FIG. 1: Connector of the prior art, already described.
Figure 2:
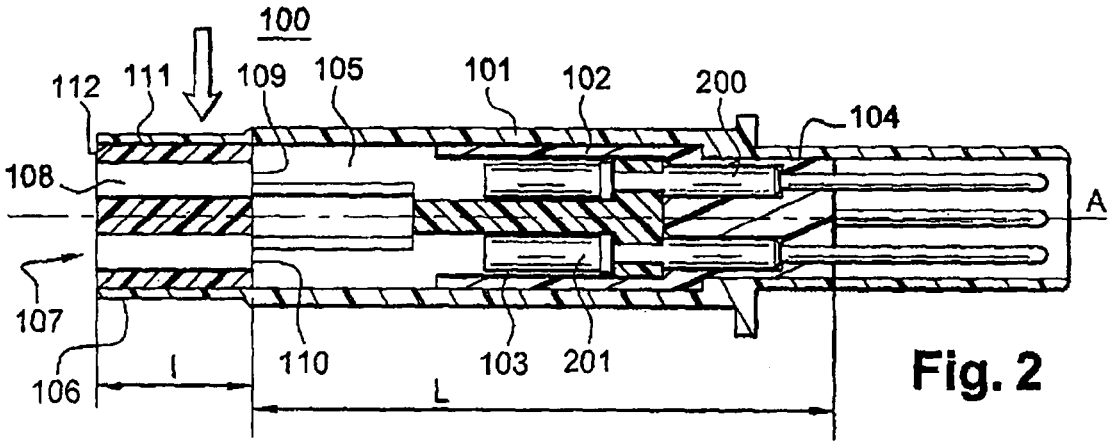
FIG. 2: A longitudinal section of a connector according to the invention.

FIG. 2 represents a connector 100 according to the invention. The connector 100 comprises a cylindrical hollow body 101. An insulant 102 is fitted inside the body 101. The insulant 102, also cylindrical, extends parallel to a longitudinal axis A of the connector 100. The insulant 102 comprises four channels 103 (only two are represented in FIG. 2) in which contacts 200 extend. The channels 103 extend in a length L of the insulant 102. Length L of the insulant 102 refers to the dimension of the insulant 102 parallel to the longitudinal axis A. The contacts 200 extend inside the channels 103 from a front extremity 104 of the insulant 102. The coaxial cables are destined to be extended in said channels 103 from the rear extremity 105 of the insulant 102, in such a way that the core of each coaxial cable is introduced in an end 201 of a contact 200. Front extremity generally refers to the extremity that is situated at right in the figures and rear extremity refers to the extremity situated at left in the figures.

Each channel 103 of the insulant 102 is therefore able to receive at the location of a rear extremity 115 a cable and at the location of a front extremity 116 a contact 200. Therefore the connection between an end 201 of a contact 200 and the core of a cable is made inside a channel 103 of the insulant 202.

According to a particular example of embodiment of the insulant 102, it is possible to arrange the channels 103 in such a way that the channels appear towards the exterior. The channels 103 are then hollow from a periphery of said insulant 102. It is also possible to make channels 103 in such a way that the channels partially appear and are partially surrounded along the entire perimeter of the wall of the insulant 102.

The connector 100 according to the invention is equipped with a ferrule 107 housed at the location of the rear extremity 106 of the body 101. The exterior contours of the ferrule 107 and the insulant 102 follow the interior contour of the body 101 of the connector 100, that is, they are adapted to be housed in said body 101. The ferrule 107 has a general cylindrical tubular shape in which four cavities 108 are arranged (two cavities are visible in FIG. 2). Each cavity 108 extends parallel to the longitudinal axis A of the connector 100 along the entire length I of the ferrule 107. Length I of the ferrule 107 refers to the dimension of the ferrule 107 parallel to the axis A of the connector 100. Therefore, the cavities 108 are through cavities and appear on both sides of the ferrule 107. In another example of embodiment, the cavities are hollow from the external wall 111 of the ferrule 107, in such a way as to appear towards the exterior of said ferrule 107.

The front extremity 109 of each cavity 108 coincides with the rear extremity 110 of a corresponding channel 103 of the insulant 102. Coincide means that each cavity 108 appears in a channel 103. Therefore, a cable housed in a cavity 108 may also extend in the corresponding channel 103 of the insulant 102 up to an end 201 of a contact 200 to which it must be connected.

Figure 4:
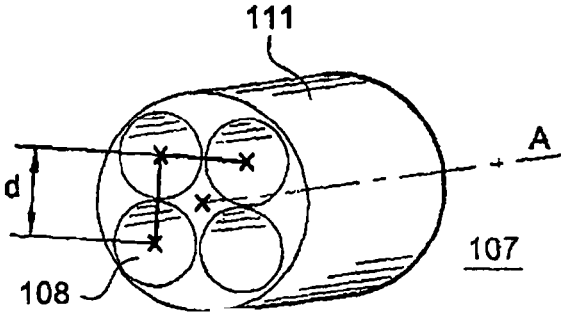
FIG. 4: A schematic representation of a ferrule according to the invention.

FIG. 4 represents a ferrule 107 according to the invention. The geometry of the cavities 108 inside the ferrule 107 may be identical to the geometry of the channels 103 inside the insulant 102. The cavities 108 are symmetrical two by two with relation to the axis A of the connector 100.

Therefore, the four cables are arranged from the exterior of the connector 100 up to the interior of ends 201 of the contacts 200 in a quadraxial disposition, that is, with an axial symmetry.

The diameter of cavities 108 in the ferrule 107 must be sufficient for receiving a coaxial cable lacking the exterior sheath, but surrounded by a braided metallic sheath. The diameter of cavities 103 itself must be sufficient for receiving said cable lacking the braided metallic sheath.

The ferrule 107 is made in a conductive material so that the exterior conductors of the coaxial cables are maintained at the same potential. The cavities 108 are arranged by pairs on both sides of the longitudinal axis A of the connector 100, that also corresponds to the longitudinal axis of the ferrule 107. The pairs of cavities 108 are symmetrical with relation to the axis A. Each cavity 108 is at a distance d from adjacent cavities 108, said distance d being according to the diameter of cavities 108 and to the diameter of the ferrule 107. Therefore, each cavity 108 is equidistant from each of the adjacent cavities 108. This disposition of cavities 108 in the ferrule 107 allows passage for the coaxial cables inside the connector 100 to be created from the ferrule 107 to the insulant 102, the geometry of the channels 103 in the insulant 102 continuing the geometry of the cavities 108 in the ferrule 107.

In a particular example of embodiment of the ferrule 107 of the invention, the exterior diameter of the ferrule is approximately 5 mm, plus or minus 0.5 mm, for a length I of 6 mm, plus or minus 0.5 mm. The diameter of the body 101 of the connector 100 is for example 7 mm of exterior diameter, plus or minus 0.7 mm for a length of 35 mm.

In order to maintain the ferrule 107 in the body 101 of the contact 100, it may be necessary to crimp the rear extremity 106 of the body 101 on the ferrule 107. For example, for a ferrule 107 of length I of approximately 6 mm, plus or minus 0.5 mm, and exterior diameter 5 mm, plus or minus 0.5 mm, and for a body 101 of contact of exterior diameter of approximately 7 mm, plus or minus 0.5 mm, it is possible to crimp the rear extremity 106 of the body 101 on a length of approximately 5 mm.

In another example of embodiment of the invention, the ferrule 107 may be maintained in the body 101 of the connector 100 by soldering.

It is also possible to make a ferrule 107 whose diameter is such that the ferrule 107 is inserted by force inside the body 101. The ferrule 107 is then maintained at the location of the rear extremity 106 of the body 101 by a tight contact of the external wall 111 of the ferrule 107 with the internal wall 112 of the body 101 of the connector 100.

Figure 3:
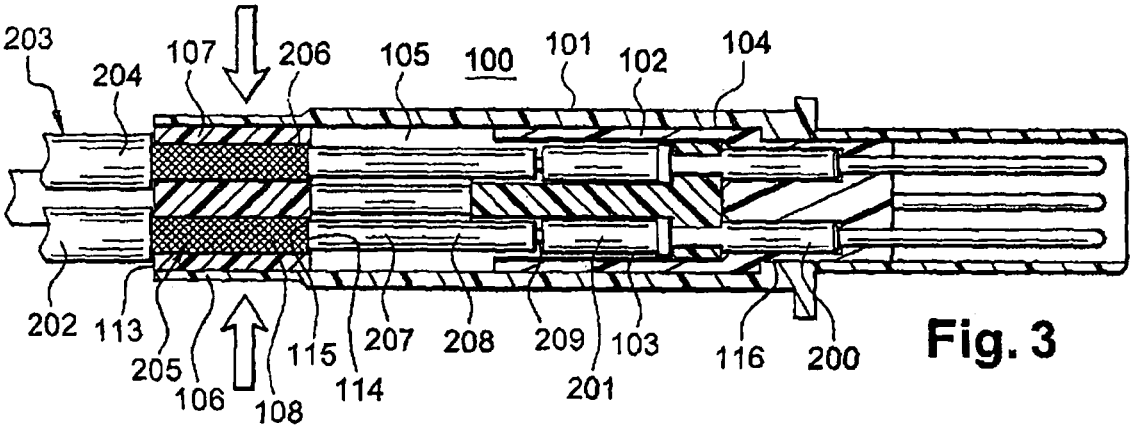
FIG. 3: The connector according to FIG. 2 equipped with coaxial cables.

FIG. 3 represents the connector 100 in which coaxial cables 202 are fitted (only two cables are visible in FIG. 3). Each coaxial cable 202 is equipped at the location of an external section 203, situated outside the connector 100, with a sheath 204. The sheath 204 may be present along the entire cable 202 from the end of the connector 100 up to the electronic device to which the cable 202 must be connected. It is also possible that the cable 202 is lacking such a sheath 204, or is only partially equipped with a sheath, for example on a portion of cable destined to be in an environment necessitating this protection. Each cable 202 is partially stripped in such a way as to obtain three different internal sections. Internal section refers to a section destined to be housed in a channel 103 of the insulant 102 and/or a cavity 108 of the ferrule 107.

A first internal section 205 is formed from the coaxial cable lacking the sheath 204, but surrounded by a braided metallic sheath 206.

A second internal section 206 is lacking the braided metallic sheath 206, but is surrounded by an insulating sheath 208 of the coaxial cable 202.

Lastly, a third internal section 209 is formed by the core of the coaxial cable 202. The third section 209 forms the free extremity of the coaxial cable 202. Free extremity refers to the extremity of the coaxial cable 202 destined to be housed in the end 201 of the corresponding contact 200.

Once each coaxial cable 202 is stripped in such a way as to obtain the three internal sections 205, 207 and 209 respectively, the coaxial cable 202 is introduced inside a cavity 108 of the ferrule 107 by the free extremity 209. The ferrule 107 is guided along the coaxial cable 202 or the cable 202 is pushed inside a cavity 108 of the ferrule 107 until the section 205, surrounded by the braided metallic sheath 206, is housed in a cavity 108 of the ferrule 107. The sheath 204 of the coaxial cable 202 may then be stopped against the rear extremity 113 of the corresponding cavity 108 when the diameter of the cavities 108 of the ferrule 107 is less than the diameter of the coaxial cable 202 surrounded by the external sheath 204.

Then the same cable 202 is introduced through the free extremity 209 inside a channel 103 in the insulant 202 until the second section 207 is housed in the insulant 102 at the location of the rear extremity 105 of said insulant 102, the core 209 of the coaxial cable 202 being then housed in the insulant 102 at the location of the front extremity 104 of said insulant 102.

The front extremity 114 of the first section 205 of cable 202, equipped with the metallic braid 206, may abut against the rear extremity 114 of a channel 103 of the insulant 102 when the diameter of the channels 108 of the insulant 102 is less than the diameter of the coaxial cable 202 surrounded by the metallic sheath 206.

In the example represented in FIG. 3, the diameter of the cavities 108 is fully greater than the diameter of the channels 103, inasmuch as the channel 103 is destined to receive a diameter of cable fully less than the diameter of cable housed in the cavity 108.

The contacts 200 may be fitted in the insulant 102 before or after the coaxial cables 202.

Once the assembly of coaxial cables 202 and contacts 200 is fitted in the ferrule 107 and the insulant 102, the coaxial cables 202, ferrule 107, insulant 102 and contacts 200 assembly is introduced, for example by translation, inside the hollow body 101 of the connector 100.

Once the ferrule 107 is housed inside the body 101 of the connector 100, it is possible to crimp the rear extremity 106 of the body 101 on the ferrule 107 in such a way as to press the rear extremity 106 of the body 101 on the external wall 111 of the ferrule 107. Contact between the conductive ferrule 107 and the metallic body 101 of the connector 100 is therefore guaranteed.

The invention claimed is:

1. A connector comprising:

an insulant comprising four channels, each channel adapted to receive a coaxial cable at a location of a rear extremity and an end of a contact at a location of a front extremity to connect each coaxial cable to an end of a contact; and a ferrule comprising four cavities arranged such that a front extremity of each cavity coincides with a rear extremity of a channel of the insulant such that each coaxial cable connected to an end of a contact in the connector extends in a cavity of the ferrule and in a corresponding channel of the insulant, wherein the ferrule comprises a conductive material to maintain the exterior conductors of the coaxial cables at the same potential.

2. The connector according to claim 1, wherein the cavities in the ferrule are symmetrical two by two with relation to a longitudinal axis of the connector.

3. The connector according to claim 1, wherein the insulant and the ferrule have a general tubular shape.

4. The connector according to claim 1, wherein a diameter of the cavities in the ferrule is fully greater than a diameter of the channels in the insulant such that the cavities in the ferrule are adapted to receive coaxial cables lacking a sheath but surrounded by a braided metallic sheath and channels in the insulant are adapted to receive coaxial cables lacking a braided metallic sheath but surrounded by an insulating sheath.

5. The connector according to claim 1, wherein an external wall of the ferrule is in contact with an internal wall of a body of the connector.

6. The utilization of a connector according to claim 1, with four coaxial cables, each coaxial cable being connected to an electronic component at the end of the connector.

7. A process for fitting coaxial cables in a connector according to claim 1, wherein the process comprises the following steps:

stripping a first extremity of a coaxial cable to obtain a first section of cable surrounded by a braided metallic sheath, a second section surrounded by an insulating sheaths and a third section consisting of the core of the cable, the third section forming a free extremity of the cable;

introducing the cable in a cavity of the ferrule until the first section is housed in the cavity;

introducing the cable in a corresponding channel of the insulant until the second and third sections are housed in the channel;

repeating the preceding steps for three other coaxial cables; and fitting the ferrule and the insulant, equipped with coaxial cables, in a body of the connector.

8. The process according to claim 7, including the step of introducing the contacts at an opposite extremity from the channels of the insulant in such a way that the core of each cable is housed in the end of the corresponding contact, before fitting the insulant in the body of the connector.

9. The process according to claim 7, including the step of crimping the body of the connector on the ferrule.

10. The process according to claim 7, including the step of soldering the ferrule on the body of the connector.

* * * * *

UNITED STATES PATENT AND TRADEMARK OFFICE

CERTIFICATE OF CORRECTION

PATENT NO. : 7,244,147 B2
APPLICATION NO. : 11/392389
DATED : July 17, 2007
INVENTOR(S) : De La Cruz It is certified that error appears in the above-identified patent and that said Letters Patent is hereby corrected as shown below:

Column 1, Line 41:
Delete "on" and insert --one--.

Column 8, Line 17:
Delete "sheaths" and insert --sheath,--.

Signed and Sealed this

Tenth Day of June, 2008

JON W. DUDAS
*Director of the United States Patent and Trademark Office*